United States Patent [19]

Dorn et al.

[11] Patent Number: 4,806,129

[45] Date of Patent: Feb. 21, 1989

[54] FUEL EXTENDER

[75] Inventors: George K. Dorn; Herbert A. Gilbert, both of Beaver Falls, Pa.

[73] Assignee: Prepolene Industries, Inc., Beaver Falls, Pa.

[21] Appl. No.: 206,675

[22] Filed: Jun. 15, 1988

Related U.S. Application Data

[63] Continuation-in-part of Ser. No. 98,797, Sep. 21, 1987.

[51] Int. Cl.[4] ..... C10L 1/02

[52] U.S. Cl. ..... 44/56; 44/70

[58] Field of Search ..... 44/56, 70

[56] References Cited

U.S. PATENT DOCUMENTS

| | | | |
|---|---|---|---|
| 1,423,048 | 7/1922 | Tunison | 44/56 |
| 1,474,982 | 11/1923 | Schreiber | 44/56 |
| 3,869,262 | 4/1975 | Mayerhoffer | 44/56 |
| 4,154,580 | 5/1979 | Landis | 44/56 |
| 4,392,868 | 7/1983 | Teckmeyer | 44/56 |
| 4,394,133 | 7/1983 | Smith | 44/56 |
| 4,405,336 | 9/1983 | Badger | 44/56 |

*Primary Examiner*—William R. Dixon, Jr.
*Assistant Examiner*—Margaret B. Medley
*Attorney, Agent, or Firm*—Parmelee, Miller, Welsh & Kratz

[57] ABSTRACT

An efficient and cost competitive fuel extender for mixing with lead-free gasoline used for driving internal combustion engines is provided which makes use of low grade, inexpensive naphtha as its principal ingredient that is upgraded in combination with anhydrous ethanol, toluene, aromatic benzene, xylene and a class of stabilizing and water repellent chemicals, all in a critical range of content. Its synergistic content provides a resultant product that is usable as a compatible additive for lead-free gasoline; it is extremely low in cost, and does not require any engine adjustments or fuel line protection measures; it may be provided with either a so-called regular or "MID" grade octane rating.

19 Claims, 1 Drawing Sheet

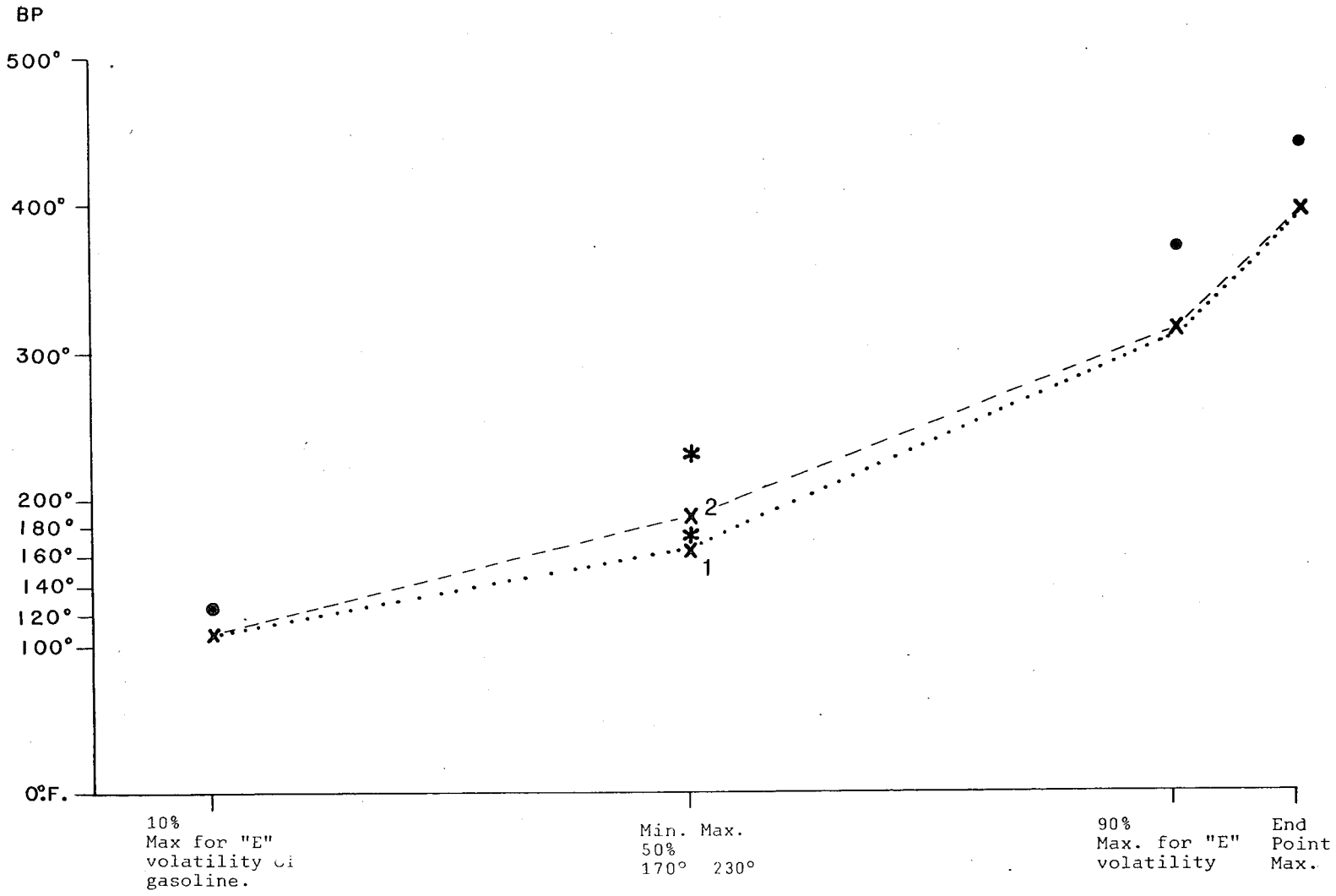
BP
500°
400°
300°
200°
180°
160°
140°
120°
100°
0°F.
10%
Max for "E"
volatility of
gasoline.
Min. Max.
50%
170° 230°
90%
Max. for "E"
volatility
End
Point
Max.
1
2

FUEL EXTENDER

This is a continuation-in-part of our application Ser. No. 098,797 filed on Sept. 21, 1987.

This invention relates to a new and improved extender formulation for gasoline such as used as a fuel in automotive applications and particularly, to an extender that is price competitive with lead-free gasoline and that will be in compliance with current EPA requirements and is thus, in its optimum form, freely usable without special waiver procedure.

In developing the invention, we found that there has been a need for a suitable oxygenated extender that is essentially lower in cost than the gasoline to which it is to be added and, at the same time, that will have stability in the presence of moisture and that can be provided with an 87 octane rating comparable with ordinary lead-free gasoline or when desired, can be provided with an octane, comparable to "mid" range of lead-free gasoline of about 88 to 89 octane.

IN THE DRAWING

FIG. 1 shows a graph that illustrates the conformance of the product, labeled IW-15, of our invention from the standpoint of current EPA gasoline distillation boiling point curve as specified in ASTM D439. This chart with separate legend set forth in this specification is believed to be self explanatory; it shows the importance of aromatic benzene, toluene and/or xylene in bringing the boiling point of the extender product to an acceptable range.

In carrying out the invention, we have, contrary to teachings in this art, been able to make use of a low cost, what we have termed residue naphtha product from a more or less basic crude oil refining process that ordinarily has a minimum of market value, that involves light, straight-run, unreformed hydrocarbon naphtha as fractionally distilled from crude oil, and that has not been cracked or reformed. It has heretofore been considered as the dreg portion of the fractional distillation of crude oil and of little value, and may be considered as the tailing of a relatively unsophisticated initial refining type of operation that can be accomplished at smaller installations that lack highly expensive and sophisticated types of cracking and reforming equipment.

In carrying out our invention, this naphtha is, however, hydrogen treated to remove sulfur to less than one part per million and, as so treated, is of a clear white color. By reason of its low specific gravity of about 0.57 to 0.70, very low octane, and high vapor pressure of about 8.5 to 12.0, it cannot be directly used as an extender for gasoline, and its boiling point skews the boiling point curve out of acceptable limits. It has a typical relatively low octane rating of about 68 to 74. This naphtha which we have termed, naphtha X, is represented by $C_4$, $C_5$ and $C_6$ hydrocarbons, typically $C_4H_{10}$, $C_5H_{12}$ and $C_6H_{14}$, having a Reid vapor pressure (RVP) of about 8.5 to 9.6 per ASTM D323 test procedure. It has an initial distillation point of about 101° F. and an end point of about 280° F.

Further, we determined that naphtha X, in itself, lacks phase stability when used along with our oxygenates, for example, as a relatively low cost by-product of a distilling operation, it has at the present time, a very low commercial or wholesale sales price of about 22 cents per gallon.

We have found that this so-called tailing, naphtha X type of product, as obtained by distillation of crude oil can, for the first time, be effectively used as a stable gasoline fuel additive up to about 35% per volume by critically formulating it with other hydrocarbons, principally benzene or toluene or combinations of benzene with toluene or xylene, and anhydrous ethanol that may be a conventionally denatured anhydrous ethyl alcohol, but treated in the extender to make it and the extender water resistant or repellant. As blended in accordance with our invention, a synergistic action takes place in which a fuel extender liquid product is attained that when added to non-leaded gasoline, provides a stable and water repellent fuel that closely corresponds to the gasoline, itself, from the standpoint of mileage obtained, comparable B.T.U. content, minimized air pollution, etc., all such that the formulated extender is fully interchangeable up to a maximum of about 35% by volume with ordinary lead-free gasoline and can also be used as an additive for ordinary leaded gasoline if desired. Gasoline having our fuel extender as a part of its content does not require engine or carburetor adjustment and is non-corrosive from the standpoint of its fuel line connections and other sensitive parts.

Our resultant extender product, as based on the critical combination of seemingly technically incompatible ingredients, has a specific gravity increased to that of ordinary commercial lead-free gasoline of a typical 87 octane and that can be further formulated, as hereinafter shown, to provide an 88 or 89 octane product. This is accomplished with favorable results from the standpoint of carbon and other combustion-produced pollutants. Our formulation, also requires no waiver procedure from the standpoint of present EPA requirements and can be adapted to make practical the use of ethanol as conventionally denatured as required, even when the denaturant is methyl alcohol which, in itself, is an undesirable ingredient.

We have further found that the optimum use of aromatics in the fuel extender requires about 5.5% benzene and about 5.0% of either toluene or xylene. The benzene maximizes octane and has high vapor pressure. The maximum amount of either benzene or toluene in the extender should not exceed about 11.5% and as an optimum, not more than about 10.5%. We found the toluene and xylene to be of similar ability to enhance octane and reduce vapor pressure. They are best used to balance the high vapor pressure of the benzene. The benzene has an octane rating of about 114, a boiling point of about 176° F. and a vapor pressure of about 50 MMHG. Typically both the toluene and xylene are each about 106 octane and their boiling points are about 230° F. and 270° F., respectively. Also, their vapor pressures are respectively about 22 MMHG and 5.10 MMHG. We have determined that ordinary oxygenates used to enhance octane are unsuitable since they exceed 2% by weight of an allowable oxygen content in the fuel. However, we have found that isopropyl alcohol as such a type of additive in a critical amount of about 1.8 to 2.4% by volume is, in combination with water repellents of the class consisting of ethyl acetate and methyl isobutyl ketone, beneficial in obtaining a fully stable product. It is not only beneficial in improving the octane rating, but has a synergistic effect with the ethyl acetate and methyl isobutyl ketone and our aromatics in improving the ethanol's water repelling and stabilized character in the effluent product. Thus, it is important in providing the best possible fuel extender commercial product.

Although anhydrous ethyl alcohol is the basic alcohol required in our extender and is now only available without special clearance as denatured ethanol, we have made an important discovery that ethyl acetate and methyl isobutyl ketone of a class which are also acceptable denaturants, will importantly function as highly effective water repellents in stabilizing amounts and surprisingly, will, within stabilizing total ranges of content in our extender product, effectively cloak or offset the presence of methyl alcohol, if it is used as a denaturant. We have found that ethyl acetate and methyl isobutyl ketone have similar water repelling properties, with the latter having a slight edge. In any event, as a class, they are substantially individually interchangeable with each other. Ethyl acetate is less costly, but methyl isobutyl ketone is more efficient in giving the effluent its water repellent property when it is used in combination with the acetate. Both are compatible with and favorably influence and react with isopropyl alcohol to provide a maximum of phase stability and water repellence. However, in all cases, to attain acceptable water repellence in the effluent product in carrying out our invention, we have found it necessary to add a stabilizing additional percentage of either or both water repellent chemicals well over and above typical ethanol denaturing formulas, namely a total range of content in the effluent of within about 0.20 to 6.0% by volume.

We have determined that ethyl acetate and methyl isobutyl ketone are of substantially equal effectiveness when used separately. Thus, in this connection, the optimum stabilizing range of total content of ethyl acetate, as used solely, is about 0.20 to 3.50% by volume in the extender, and the range of total content of methyl isobutyl ketone is the same when used solely. However, best results are obtained by using both additives, and in such event, the ketone is of more or increasing effectiveness in combination and, as an optimum, is used in a volume ratio of about 1 to 5 with respect to the acetate. However, the same total range of content applied as when they are used singularly. Restated, from the standpoint of the optimum amounts when used in combination in the ethanol, we use about 5% by volume of the ethyl acetate and about 1% by volume of the methyl isobutyl ketone. From the standpoint of the extender, itself, they are about 0.20% by volume of the acetate and about 0.04% by volume of the ketone. A border line of total content of both repellents when used together is about 0.20 to 5.75% by volume in then extender. This is compared to the optimum of both of about 0.20 to 3.50% by volume in the extender. These ranges also apply whether the denaturant content of the ethanol for therein making it unfit for human consumption, is 1% gasoline or 5% methanol.

Our basic extender composition which we have labeled IW-15, involves a critically proportioned content of naphtha X, anhydrous ethanol, water repellents of the class consisting of ethyl acetate and methyl isobutyl ketone, and benzene or toluene, or a combination of benzene and toluene, or a combination containing benzene and toluene or xylene. This basic extender is marginally stable, requires a content of the above water repellents in an upper half of their specified ranges and of the aromatics of about 4.00 to 10.5% by volume. However, the ultimate commercial extender product in accordance with our invention additionally contains anhydrous isopropyl alcohol in an amount of about 1.8to 2.4% by volume, in that it has been found to be important, not only to, in combination with the aromatics and ethanol, raise the octane rating of the extender, but to also further the water repellant property of the extender which is thus representative of a synergistic effect produced by its use in combination with at least one of the two abovementioned principal repellents. The aromatics are used to raise the octane rating, the specific gravity and the boiling point temperature of the extender to an acceptable range. Its importance from the latter standpoint is illustrated by the chart of FIG. 1. In this chart:

IW-15 without toluene boiling points plot represented by . . . . . .
IW-15 with toluene boiling points plot represented by - - - - - - - - - -
Large single dot plots represent: fuel distillation maximum boiling point temperatures for ASTM D439 "E" class volatility at 10% (122° F.), 90% (365° F.), and end point (437° F.).
Asterisks represent: maximum and minimum fuel boiling point temperatures for ASTM D439 "E" class volatility at 50% of IW-15 fuel's distillation.
X 1=point plotted represents 50% of IW-15 fuel's distillation without toluene in the blend. X 1. point as ploted sags or drops below the minimum allowable lower limit of 170° F.
X 2=point ploted represents 50% of IW-15 fuel's distillation with toluene.
X 2 point as plotted fails within the maximum and minimum allowable BP limits of 230° F. and 170° F.
Shows that IW-15 with toluene conforms to ASTM D439 "E" class fuel volatility standard.
Unnumbered plain X's represent fuel distillation boiling points that conform to ASTM table 1 for gasoline volatility class "E"'.

When 5% methanol is used as the denaturant, we prefer to add slightly more of the acetate and/or ketone to the content of the extender within their previously indicated ranges of content to offset any adverse effect of the methyl alcohol represented by its relatively small percentage of content from the standpoint of the overall extender product.

Cost Comparisons

| | | | |
|---|---|---|---|
| **Optimum Formula Using Our IW-15 to Provide 87 Octane Fuel** | | | |
| 87 octane commercial unleaded gasoline | 65.55% | @55¢/gal | 36.05¢ |
| 71.7 octane naphtha "X" | 18.25% | @22¢/gal | 4.02¢ |
| Anhydrous ethanol containing water repellent* | 3.80% | @92¢/gal | 3.50¢ |
| Anhydrous isopropanol | 1.90% | @1.50/gal | 2.85¢ |
| Benzene | 5.50% | @.89¢/gal | 4.90¢ |
| Toluene or xylene or both | 5.00% | @.67¢/gal | 3.35¢ |
| Fuel | 100.00% | | 54.67¢ |
| **Optimum Formula Using Our IW-15 to Provide 88 Octane Fuel** | | | |
| 88 octane commercial unleaded gasoline | 65.55% | @56.26¢/gal | 37.04¢ |
| 74 octane naphtha "X" | 18.25% | @22¢/gal | 4.02¢ |
| Anhydrous ethanol containing water repellent* | 3.80% | @92¢/gal | 3.50¢ |
| Anhydrous isopropanol | 1.90% | @1.50/gal | 2.85¢ |
| Benzene | 5.50% | @.89¢/gal | 4.90¢ |
| Toluene or xylene or both | 5.00% | @.67¢/gal | 3.35¢ |
| Fuel | 100.00% | | 55.66¢ |
| **Optimum Formula Using Our IW-15 to Provide 89 Octane Fuel** | | | |
| 89 octane commercial unleaded gasoline | 65.55% | @58¢/gal | 38.02¢ |
| 71.7 octane naphtha "X" | 18.25% | @22¢/gal | 4.02¢ |
| Anhydrous ethanol containing water repellent* | 3.80% | @92¢/gal | 3.50¢ |
| Anhydrous isopropanol | 1.90% | @1.50/gal | 2.85¢ |
| Benzene | 5.50% | @.89¢/gal | 4.90¢ |

-continued

| Cost Comparisons | | | |
|---|---|---|---|
| Toluene or xylene or both | 5.00% | @.67¢/gal | 3.35¢ |
| Fuel | 100.00% | | 56.64¢ |

*The water repellent cost based on the optimum 5 to 1 ratio of .20% ethyl acetate and .04% methyl isobutyl ketone of the extender content is only .005¢ and is included in the 3.50¢.

As compared to the above, the cost of 87 octane unleaded gasoline is 55.0¢ per gallon and of 89 octane unleaded gasoline is 58.0¢ per gallon. Also, by way of comparison, the cost of fuel provided in accordance with the optimum formula of U.S. Pat. No. 4,392,868 is as follows:

| | | | |
|---|---|---|---|
| 87 octane commercial unleaded gasoline | 60.00% | @55¢/gal | 33.00¢ |
| Naphtha "Z" | 32.95% | @1.30¢/gal | 42.84¢ |
| Anhydrous ethanol | 4.70% | @.92¢/gal | 4.32¢ |
| Anhydrous isopropanol | 2.35% | @1.50¢/gal | 3.53¢ |
| Fuel | 100.00% | | 83.69¢ |

Summarized briefly, to provide the ultimate commercial product in accordance with our invention, we use our fuel extender liquid in a maximum amount of up to about 35% by volume in lead-free gasoline and such extender contains the following ingredients within the following ranges: naphtha X of about 10 to 25% (15 to 22% optimum) by volume, anhydrous ethanol of about 3.8 to 6.0% (3.8 to 4.14% optimum) by volume, anhydrous isopropyl alcohol of about 1.8 to 2.4% (1.8 to 2.07% optimum) by volume, and aromatics benzene and toluene 4 to 10.5% (5 to 10.5% optimum) by volume. In this connection, the ratio of benzene to toluene or to xylene or to toluene plus xylene should be about 1 to 1. The principal water repellents of the class consisting of ethyl acetate and methyl isobutyl ketone, when employed separately (each being substantially equivalent), are within a range of about 0.20 to 5.75% (0.20 to 3.50% optimum) by volume in the extender product or about 4.8 to 20% in the ethanol.

The resultant product constitutes an extender additive containing lead-free gasoline for automotive fuel usage in which the gasoline content constitutes at least about 65% by volume thereof and the total amount of the extender additive constitutes up to about 35% by volume thereof. In the extender, the range of content of each individual ingredient is thus based on by volume percentages thereof represented by volume in or as to such resultant product.

We claim:

1. An efficient and cost competitive fuel extender liquid for blending with lead-free gasoline as an additive thereto in a maximum amount of up to about 35% thereof with 65% by volume of the gasoline in a blended mixture wherein, the content of said extender in the resultant fuel as proportioned on the basis of its thus representative maximum content consists essentially of: naphtha X as represented by $C_4$, $C_5$ and $C_6$ hydrocarbons having a Reid vapor pressure of about 8.5 to 9.6 per ASTM, D323 test procedure and an initial distillation point of about 101° F. and an end point of about 280° F. within a range of about 10 to 25% by volume, about 3.8 to 6.0% by volume of anhydrous ethanol, a stabilizing amount of a water repellent of the class consisting of ethyl acetate and methyl isotubyl ketone; and about 4 to 10.5% by volume of aromatics benzene and toluene, of benzene and xylene or of benzene with toluene and xylene; said extender having a specific gravity substantially comparable with that of the lead-free gasoline to which it is to be added and having phase stability in the presence of water when mixed with the gasoline.

2. A fuel extender as defined in claim 1 having a substantially full phase stability which additionally contains isopropyl alcohol within a range of about 1.8 to 2.4% by volume.

3. A fuel extender as defined in claim 1 wherein the stabilizing amount of the water repellent is about 0.20 to 5.75% by volume in the effluent.

4. A fuel extender as defined in claim 1 having about 0.20 to 5.75% by volume of the water repellent and which additionally contains about 1.0 to 2.4% by volume of isopropyl alcohol.

5. A fuel extender as defined in claim 4 wherein, the optimum range of content of the naphtha X is about 10 to 24% by volume, of the anhydrous ethanol is about 3.8 to 4.14% by volume, of the isopropyl alcohol is about 1.8 to 2.07% by volume, of the total content of the aromatics benzene, toluene and xylene is about 4 to 10.5% by volume, and of the water repellent is about 0.20 to 3.5% by volume.

6. A fuel extender as defined in claim 1 wherein the naphtha X contains hydrocarbons of the class consisting of $C_4H_{10}$, $C_5H_{12}$ and $C_6H_{14}$, is hydrogen treated to remove sulfur to less than about one part per million, and is substantially clear in color.

7. A fuel extender as defined in claim 4 wherein the methyl isobutyl ketone is used in combination with and in a volume ratio of about 1 to 5 with respect to the ethyl acetate.

8. A fuel extender as defined in claim 1 wherein the water repellent has a total content by volume of about 0.20 to 5.75% in the extender, and the methyl isobutyl ketone is used in combination with and in a volume ratio of about 1 to 5 with respect to the ethyl acetate.

9. A fuel extender as defined in claim 4 wherein the naphtha X has an octane rating of about 68 to 74, a specific gravity of about 0.57 to 0.70, and a vapor pressure of about 8.5 to 12.0.

10. A fuel extender as defined in claim 4 having an octane rating of about 87 wherein, the naphtha X is in an amount of about 24% by volume, the benzene is in an amount of about 5.7% by volume, the toluene, the xylene or both is in an amount of about 5% by volume, the anhydrous ethanol is in an amount of about 4% by volume, and the anhydrous isopropanol is in an amount of about 2% by volume.

11. A fuel extender as defined in claim 4 having an octane rating of about 89 wherein, the naphtha X is of about 74 octane and in an amount of about 18% by volume, benzene is in an amount of about 5.5% by volume, the toluene, the xylene or both is in an amount of about 5% by volume, the anhydrous ethanol is in an amount of about 4% by volume, and the anhydrous isopropanol is in an amount of about 2% by volume.

12. A fuel extender as defined in claim 10 wherein the water repellent content is about 0.20% ethyl acetate and about 0.04% methyl isobutyl ketone.

13. A fuel extender as defined in claim 11 wherein the water repellent content is about 0.20% ethyl acetate and about 0.04% methyl isobutyl ketone.

14. A fuel extender as defined in claim 4 wherein the benzene is in an amount of about 5% by volume in the extender.

15. A fuel extender as defined in claim 4 wherein the toluene is in an amount of about 10% in the extender.

16. A fuel extender as defined in claim 4 wherein the water repellent is ethyl acetate or methyl isobutyl ketone or both within the specified range of content.

17. A fuel extender as defined in claim 4 wherein the benzene is in an amount of about 10.5% by volume in the extender.

18. A fuel extender as defined in claim 4 wherein the toluene is in an amount of about 10.5% by volume in the extender.

19. A fuel extender as defined in claim 4 wherein the extender is introduced into lead-free gasoline of a minimum of about 87 to 89 octane and the resultant product has substantially the same octane as the gasoline into which it is introduced.

* * * * *